US005778624A

United States Patent [19]

Russell

[11] Patent Number: 5,778,624

[45] **Date of Patent: *Jul. 14, 1998**

[54] WALL PATCHING ELEMENT

[76] Inventor: Thomas C. Russell, 3047 Wendmead Pl., Marietta, Ga. 30062

[ * ] Notice: The term of this patent shall not extend beyond the expiration date of Pat. No. D. 367,596.

[21] Appl. No.: 736,654

[22] Filed: Oct. 25, 1996

[51] Int. Cl.[6] ..... E04G 23/02

[52] U.S. Cl. ..... 52/514; 52/741.41; D8/14; D8/499; D25/199

[58] Field of Search ..... 52/514, 514.5, 52/741.41, 742.13; D8/14, 499; D25/199

[56] References Cited

U.S. PATENT DOCUMENTS

| | | | |
|---|---|---|---|
| D. 367,596 | 3/1996 | Russell | D8/14 |
| 2,997,416 | 8/1961 | Helton | 156/98 |
| 3,325,955 | 6/1967 | Haut | 52/514 |
| 3,373,467 | 3/1968 | Loughrey | 52/514 X |
| 3,874,505 | 4/1975 | Mirarchi et al. | 52/514 X |
| 4,075,809 | 2/1978 | Sirkin | 52/514 |
| 4,193,243 | 3/1980 | Tiner | 52/514 |
| 4,471,594 | 9/1984 | Doyle | 156/98 X |
| 4,620,407 | 11/1986 | Schmid . | |
| 4,715,151 | 12/1987 | Garblik . | |
| 4,776,906 | 10/1988 | Bernard | 52/514 X |
| 4,809,478 | 3/1989 | Bernard | 52/514 |
| 4,989,385 | 2/1991 | McCullough | 52/514 |
| 5,033,949 | 7/1991 | Jewett | 52/514 X |
| 5,269,861 | 12/1993 | Gilbreath | 52/514 X |

*Primary Examiner*—Carl D. Friedman
*Assistant Examiner*—Kevin D. Wilkens
*Attorney, Agent, or Firm*—Terry M. Gernstein

[57] ABSTRACT

A wallboard patching element is collapsible to fit through a hole in the wallboard. Using a handle, the element is moved through the hole and inside the wall adjacent to the hole. Once inside the wall, the element is released into a fully deployed condition with part of the element larger than the hole. The patching element has adhesive on portions that contact the wall, and is moved into contact with the wall. Once the patching element is fixed to the wall, the handle is removed, and tape or other patching material is used to fill in any gaps remaining between the patching element and the wall.

15 Claims, 6 Drawing Sheets

WALL PATCHING ELEMENT

FIELD OF THE INVENTION

The present invention relates to the general art of static structures, and to the particular field of patching holes in walls of buildings.

BACKGROUND OF THE INVENTION

Many buildings include walls made of wallboard. This material is very popular and has been used for many years. However, wallboard is susceptible to having holes punched in it. Door knobs, chairs, toys and the like have all been known to punch holes in wallboard. In fact, this problem is so prevalent that the art contains many means for patching and covering such holes. These means include tape, plaster-like materials, etc.

While these means work well for small holes, large holes (i.e., holes larger than about two inches in diameter at the smallest opening) present a problem. In the case of large holes, it is difficult to provide support for patching material, such as patching plaster or the like. Large holes often require replacing an entire section of wallboard. This can be expensive, and may require the services of a skilled craftsman.

Therefore, there is a need for a means and a method for easily and expeditiously repairing large holes in wallboard. There is a further need for a means and a method for easily and expeditiously repairing large holes in wallboard without requiring replacement of large sections of the wallboard.

OBJECTS OF THE INVENTION

It is a main object of the present invention to provide a means and a method for easily and expeditiously repairing large holes in wallboard.

It is another object of the present invention to provide a means and a method for easily and expeditiously repairing large holes in wallboard without requiring replacement of large sections of wallboard.

SUMMARY OF THE INVENTION

These, and other, objects are achieved by an element which is collapsible to fit through a large hole in a wallboard, and will return to its initial shape once inside the wall behind the wallboard being repaired, and then can be fixed to the wallboard in a manner that fills in a large hole. The patching element fills the large hole and only small spaces, similar to small holes, will remain. Tape or other patching material can then be applied to the wallboard/patching element in a manner similar to that associated with patching small holes.

BRIEF DESCRIPTION OF THE DRAWING FIGURES

DETAILED DESCRIPTION OF THE PREFERRED EMBODIMENT OF THE INVENTION

Shown in FIGS. 1–5 is an element 10 used in patching a hole H in wallboard W. Hole H has been defined around another hole, indicated at F in FIG. 1. Hole H is large enough so the patching element 10 can be fit through the wall after that patching element has been collapsed as will be discussed below. Hole H is preferably rectangular in shape. Once patching element 10 is in place, only small holes will remain between element 10 and wall W as indicated at H' in FIG. 2. As discussed above, for purposes of this disclosure, a large hole has a diameter of approximately two inches at its smallest dimension. Therefore, holes H' are all smaller than two inches across at their smallest dimensions, and can be patched in a way known to those skilled in the art, including taping, spackling and the like. A small hole can be easily filled in, and someone who is not skilled can apply the tape or the like necessary to complete this job.

Figure 1:
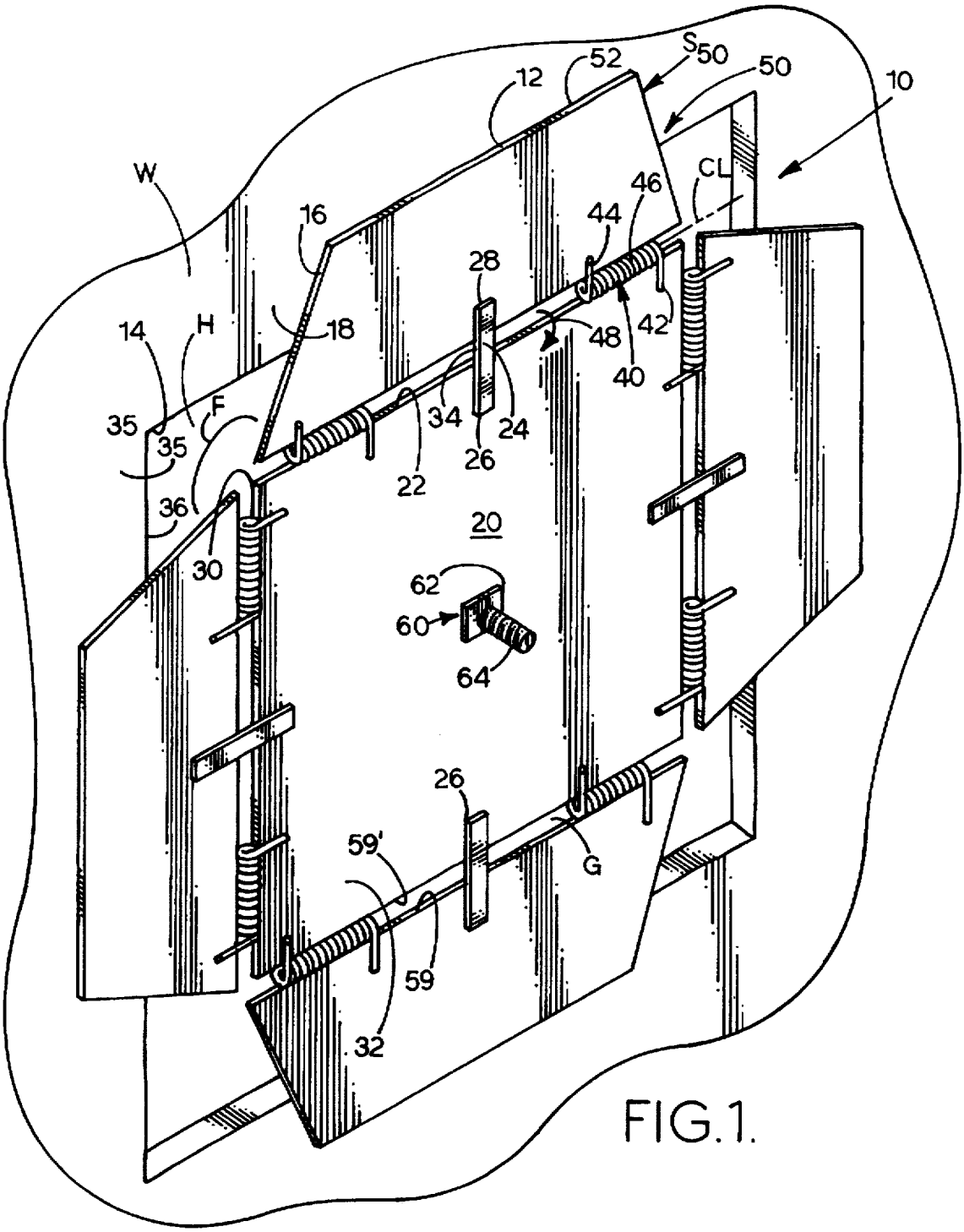
FIG. 1 is a rear perspective view of an element used to patch large holes in wallboard, in the fully open condition.
Figure 2:
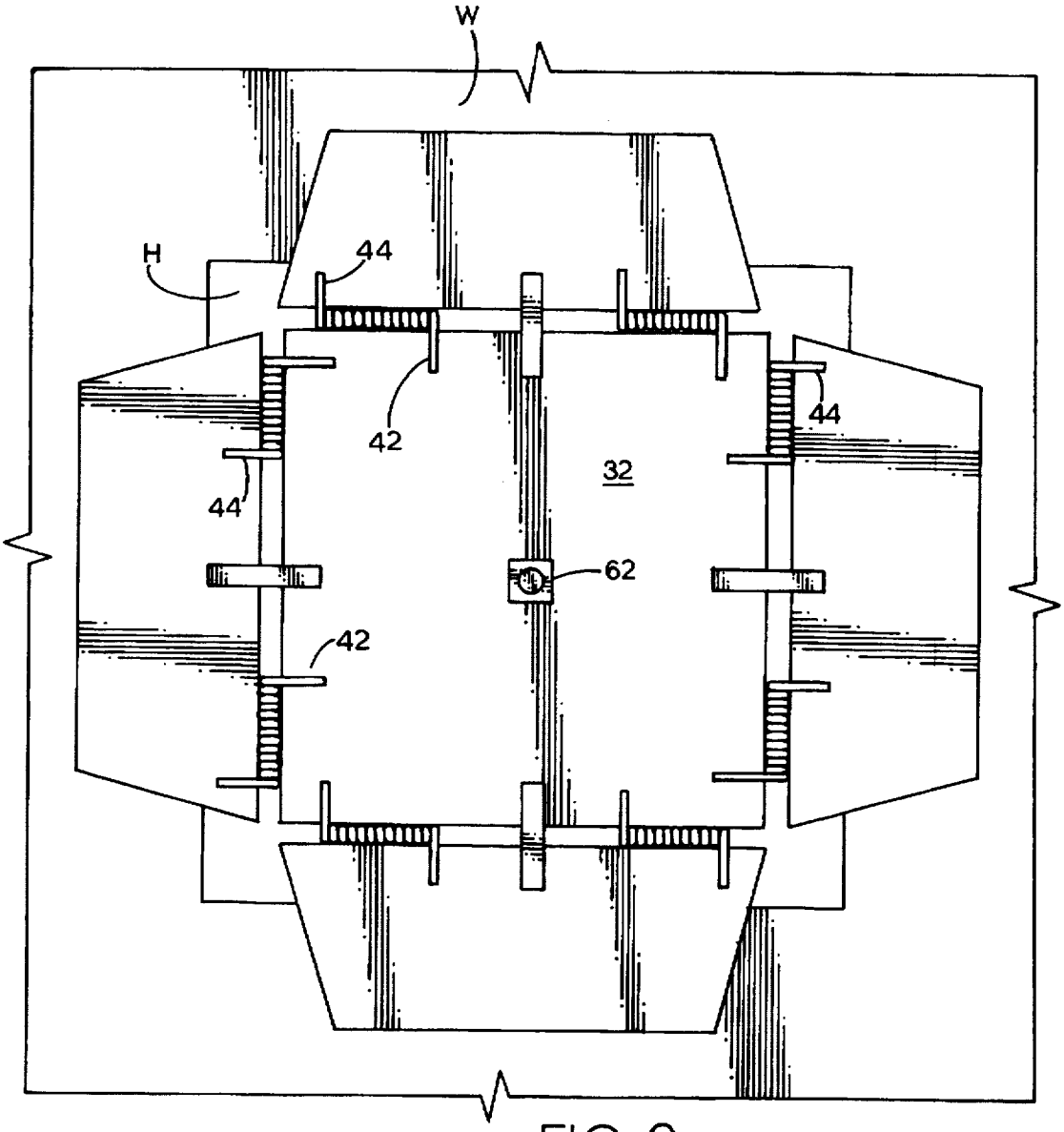
FIG. 2 is a rear plan view thereof.
Figure 3:
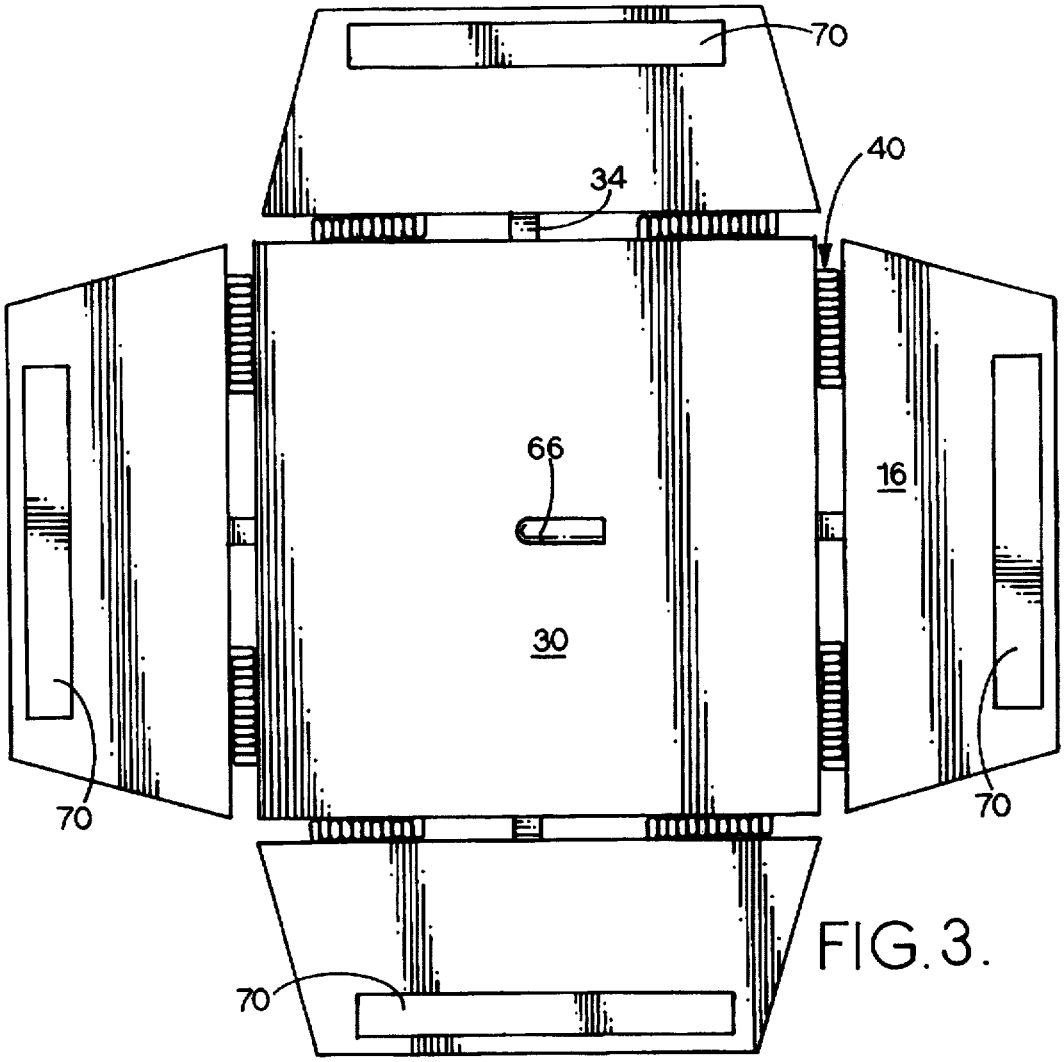
FIG. 3 is a front plan view thereof.

As can be seen in FIG. 1, patching element 10 when fully deployed is larger than hole H. Therefore, as will be understood from the following disclosure, patching element 10 is collapsed and then moved through hole H. Once inside the wall, with FIG. 1 showing the patching element inside a wall, with wall W being shown in FIG. 1 from inside the wall, patching element 10 expands into the configuration shown in FIG. 1 with outer edges 12 being located adjacent to the wall W and spaced from the edges 14 of the wallboard adjacent to hole H. Thus deployed and sized, surface 16 of element 10 will contact wallboard W adjacent to hole H at surface 18 for fixing element 10 to wall W as will be understood from the following disclosure.

Figure 4:
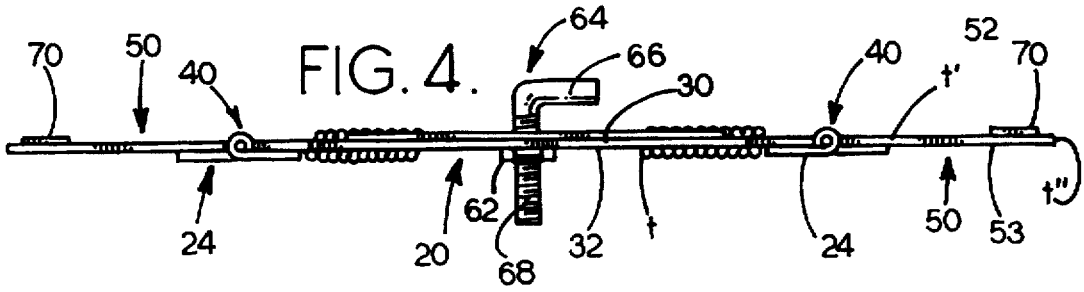
FIG. 4 is an elevational view thereof.

Patching element 10 includes a planar central section 20 having peripheral edges, such as edge 22, and is rectangular in peripheral shape, preferably square as shown in the figures. A plurality of brace elements, such as brace element 24, are each fixed adjacent to one end 26 thereof to central section 20. The brace elements are all identical, and thus only one brace element will be described, it being understood that the discussion applies to all of the brace elements. Brace element 24 extends past peripheral edge 22 of central section 20 and has another end 28 spaced from that peripheral edge 22. Central section 20 includes a front surface 30 shown in FIG. 3 and a rear surface 32 shown in FIGS. 1 and 2. Brace element 24 has a front surface 34 shown in FIG. 3 that is co-planar with rear surface 32. The purpose of the brace elements will be understood from the following discussion. The thickness of the central section 20 as measured between front surface 30 and rear surface 32 is indicated in FIG. 4 by the reference numeral t. Thickness t can be essentially equal to the thickness of wallboard W as measured between rear surface 35 and front surface 36. Other thicknesses for section 20 can also be selected as will occur to those skilled in the art based on the teaching of the present disclosure.

Patching element 10 further includes a plurality of spring elements, such as spring 40. All of the spring elements are identical, and thus only spring element 40 will be discussed. Spring element 40 has one end 42 thereof fixed to central section 20 and a second end 44. Spring 40 has a body 46 oriented to be parallel to peripheral edge 22 and is an ordinary torsion spring that biases ends 42 and 44 toward each other in a rotational manner about the longitudinal centerline CL of the spring as indicated by clockwise arrow 48 in FIG. 1.

Patching element 10 further includes a plurality of flap elements, such as flap element 50, each of which is fixed to the second end 44 of the springs 40 to be movably attached to central section 20 by the springs. Each of the flap elements are identical, and thus only flap element 50 will be described. Flap element 50 moves between a first position $F_{50}$ shown in FIG. 5 at an angle to central section 20 and a second position $S_{50}$ shown in FIG. 1 and which is co-planar with central section 20. Because the springs are each biased in directions such as direction 48 with respect to their longitudinal centerlines, the springs bias the flap elements toward second position $S_{50}$. Due to this bias, the flap elements tend to assume position $S_{50}$, and must be physically moved into position $F_{50}$ to be moved through hole H. However, once through hole H and inside the wall, the flaps expand into the positions shown in FIG. 1. Each flap element abuts an associated brace element when the flap element is in the second position. The brace elements are sized to have a thickness t' (see FIG. 4) essentially equal to thickness t of the central section and the flap elements are sized to have a thickness t" as measured between front surface 52 and rear surface 53 essentially equal to thickness t so that front surface 52 of each of the brace elements is co-planar with front surface 30 of central section 20. This co-planar relationship orients the front surface 30 of the central section 20 in a desired relation with the wall. Surface 30 will be co-planar with rear surface 35 of wall W and patching element 10 spans hole H so an anchor is provided on which wall patching materials, such as tape or the like, can be fixed to close the hole in the wall.

As shown, there are four brace elements, but there could be more or less than four. There are also four flap elements. However, there could be more or less flap elements as desired. For example, if central section 20 is a hexagon, there would be six edges and six braces and six flap elements. There could also be more than one brace element on each edge, or there could be edges without any flap element associated therewith. Those skilled in the art will be able to design variations of the disclosed invention that fall within the scope of this disclosure based on the teaching of this disclosure. Furthermore, the flap elements are shown as being trapezoidal in shape, but could be other shapes as well without departing from the scope of this invention. Central section 20 is also shown as being planar, but could be arcute if desired. For example, an arcuate shape may be desirable for aesthetic reasons or to match the shape of a wall. The flap elements are spaced from the central section to define gaps, such as gap G, between inner edge 59 of each flap element and outer edge 59' of the central section. The spring element is located in this gap.

Figure 6:
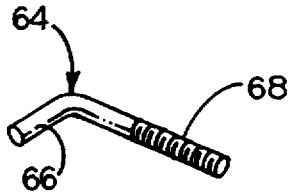
FIG. 6 is a perspective view of a fastener element used as part of a handle used to move the patching element.

Patching element 10 further includes a handle means 60 for moving the patching element. Handle means 60 is fixed to central section 20 for moving the central section toward or away from a wall to be patched. Handle means 60 includes a fastener-receiving element, such as internally threaded nut 62, fixed to the central section and a fastener, such as bolt 64 that is externally threaded to be threadably attached to the fastener-receiving element. As shown in FIG. 6, bolt 64 is L-shaped to have a hand-graspable portion 66 and a threaded portion 68. As will be discussed below, once patching element 10 is set, bolt 64 is removed from the central section.

Adhesive 70 (see FIGS. 4 and 5) is located on surface 16 of each flap element. Adhesive 70 is a contact type adhesive that fixes the flap element to the wall upon contact between the flap-supported adhesive and the wall. Thus, surface 16 of each flap element will adhere to surface 18 of each wall to fix the patching element to the wall adjacent to hole H to span that hole. While contact adhesive is preferred, other means of attaching the flap elements to the wall can be used without departing from the scope of the present invention. Thus, clips clamps or other mechanical fasteners could be used in place of adhesive 70 without departing from the scope of the present invention.

Using the patching element of the present invention, hole H is patched using the following steps and procedure. Hole F is enlarged and evened out by cutting rectangular hole H in wall W around hole F. The flap elements are then folded into first position $F_{50}$ (shown in FIG. 5 for flap 50). The collapsed patching element is moved through the rectangular hole H into the wall using the handle means while grasping the flap elements to keep them collapsed into position $F_{50}$. Once the patching element is inside the wall and positioned adjacent to the hole, the flap elements are released, and allowed to be moved under the influence of the spring elements 40 into second position $S_{50}$. Once the flap elements are all released and deployed, the handle means is used to pull the patching element towards the wall and to bring the flap elements into a position where adhesive 70 contacts the wall adjacent to hole H to fix the patching element to the wall. Because surface 30 of central section 20 and surfaces 52 of the flap elements are all co-planar, surface 30 of the patching element is nearly co-planar with rear surface 35 of the wall. Surface 30 along with the surfaces 52 of the flap element serves as an anchor for patching material with only small gaps to be filled. Once the patching element is properly positioned, bolt portion 64 of the handle means is removed from threaded engagement with nut 62 on central section 20.

Once the patching element is in place on the wall, gaps H' between the wall and the patching element are covered using known materials such as tape or the like. Only a shallow hole remains between the front surface of the patching element and front surface 36 of the wall. Such a shallow hole is easily filled and patched.

Figure 5:
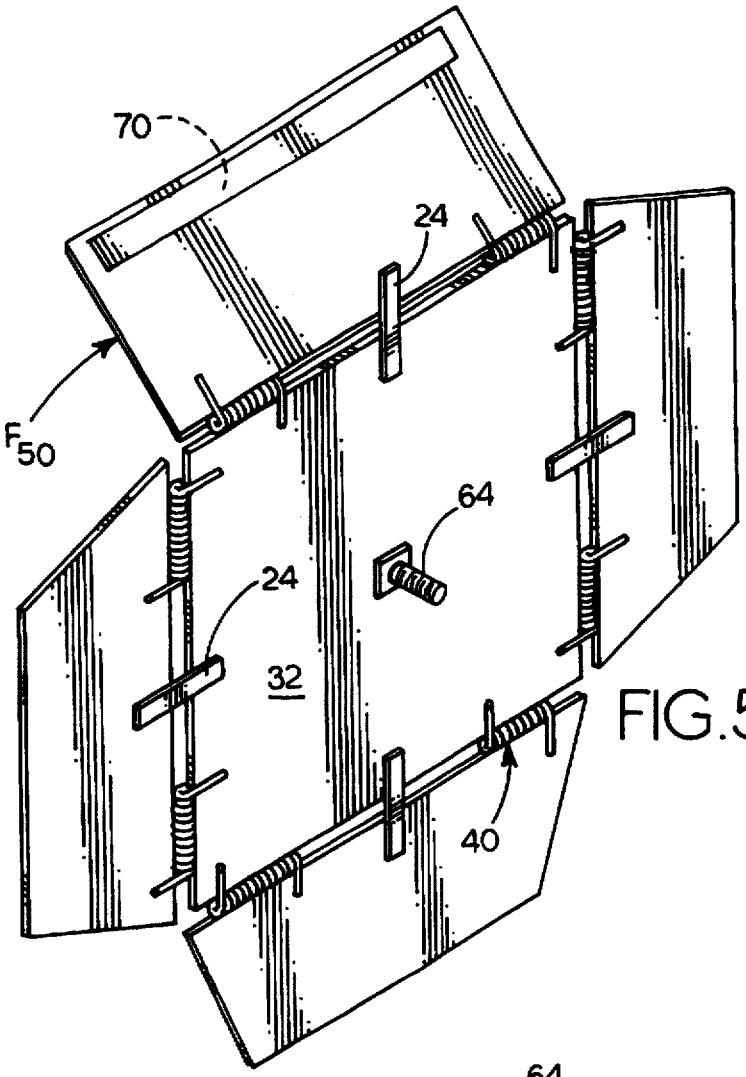
FIG. 5 is a rear perspective thereof in the partially collapsed condition.
Figure 7:
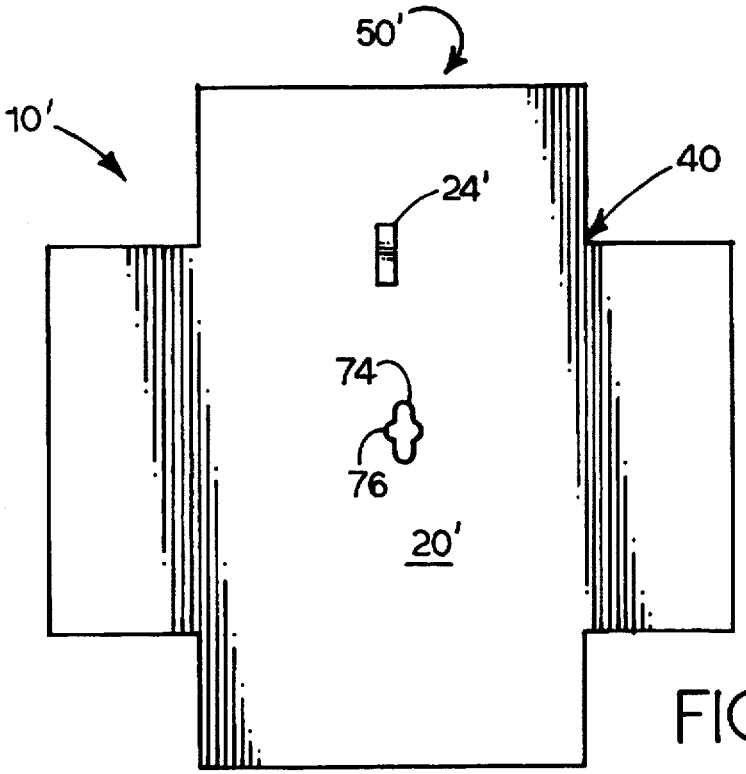
FIG. 7 is a plan view of an alternative form of the patching element.
Figure 8:
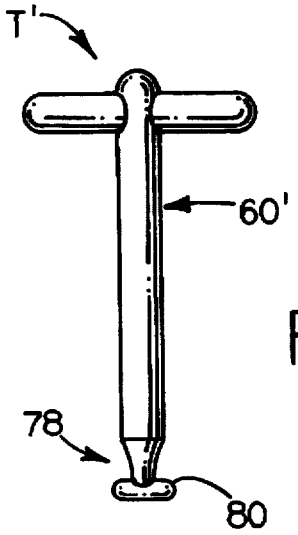
FIG. 8 is an elevational view of an alternative form of a tool used to move the patching element.

An alternative form of the patching element is shown in FIG. 7 as element 10' and includes a brace element 24' on flap element 24' to move therewith. Thus, one end of brace element 50' will be fixed to flap element 50' and the other end will abut central section 20' when flap element 50' has moved into an orientation that is co-planar with the central section. Brace element 24' can include a shoulder on the flap element. An alternative form of the spring element is a biasing hinge 40' unitarilly formed with central section 20' and connecting flap element 50' to central section 20'. The biasing hinge 40' acts in the same manner as the above-discussed springs 40 to bias the associated flap element into co-planar orientation with the central section, and the bias of hinge 40' must be overcome to move the flap element 50' from position $S_{50}$ such as is shown in FIG. 1 into position $F_{50}$ such as is shown in FIG. 5. Still further, an alternative form of the handle means is shown in FIG. 8 as handle 60' and includes a hole 74 defined in the central section having at least one notch 76 therein, and a tool T' shown in FIG. 8 that has a distal end 78 that fits through hole 74 in the central section and has a tang 80 on one side to fit through notch 76. Tool T' is oriented so tang 80 passes through notch 76, and then the tool is rotated relative to the central section to move the tool tang 80 away from notch 76 and to engage the central section adjacent to the hole. The patching element is then moved using the tool. Once the patching element is in the desired orientation and position, the tool is rotated to align the tang with the notch, and the tool is pulled through the hole to free the tool from engagement with the patching element. Yet another form of the patching element includes double sided tape, that is tape having adhesive on both sides thereof, acting as adhesive on the flap elements in a manner discussed above relative to adhesive 70.

Figure 9:
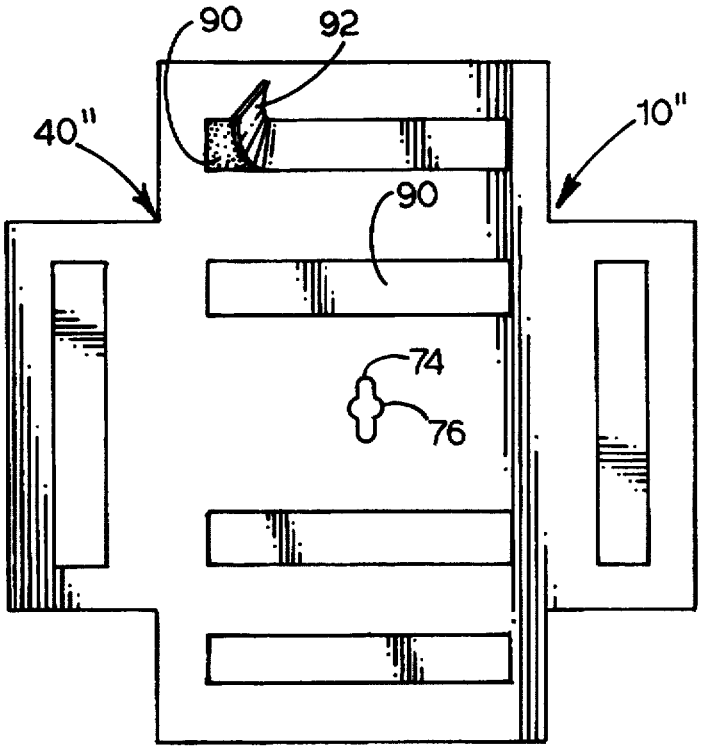
FIG. 9 is a further alternative form of the patching element of the present invention.

FIG. 9 shows yet another form of the patching element. Patching element 10" shown in FIG. 9 is similar to the body in FIG. 7, except that braces 24' have been omitted and adhesive strips 90 have been added. Adhesive strips 90 have a release layer 92 covering the adhesive. This release layer is removed prior to inserting the patching element through the wall, and will contact the inside surface of the wall when the patching element is pulled back toward the wall. The adhesive will not contact the wall during the insertion step as the folded wings will prevent such contact. Otherwise, element 10" is similar to the above described element 10'. The hinges 40" flex to permit the patching element to be forced through the hole in the wall, but the material memory of the hinges will cause the hinges to return to, or near, the planar position shown in FIG. 7. The hinges can bend only one way, and thus pulling the patching element back through the hole will not be possible as the wings will engage the rear of the wall after the hinges cause the hinges to unfold from a position assumed while the patching element is forced into the wall.

It is understood that while certain forms of the present invention have been illustrated and described herein, it is not to be limited to the specific forms or arrangements of parts described and shown.

I claim:

1. An element used in patching holes in wallboard comprising:

A) a planar central section having peripheral edges;

B) a hinge fixed at one end thereof to said central section and having a second end and having a material memory;

C) a flap element fixed to the second end of the hinge to be movably attached to said central section by said hinge, said flap element moving between a first position at an angle to said central section and a second position, said hinge material memory biasing said flap element toward said second position when said flap element is in said first position; and D) means on said central section for moving said central section toward a wall to be patched.

2. An element used in patching holes in wallboard comprising:

A) a planar central section having peripheral edges;

B) a hinge fixed at one end thereof to said central section and having a second end and having a material memory;

C) a flap element fixed to the second end of the hinge to be movably attached to said central section by said hinge, said flap element moving between a first position at an angle to said central section and a second position co-planar with said central section, said hinge material memory biasing said flap element toward said second position when said flap element is in said first position; and D) means on said central section for moving said central section toward a wall to be patched.

3. An element used in patching holes in wallboard comprising:

A) a planar central section having peripheral edges;

B) a brace element fixed at one end thereof to said central section and extending past one peripheral edge of said central section and having another end spaced from said one peripheral edge;

C) a spring having one end thereof fixed to said central section and a second end;

D) a flap element fixed to the second end of said spring to be movably attached to said central section by said spring, said flap element moving between a first position at an angle to said central section and a second position co-planar with said central section, said spring biasing said flap element toward said second position and said flap element abutting said brace element when said flap element is in said second position; and E) means on said central section for moving said central section toward a wall to be patched.

4. An element used in patching holes in wallboard comprising:

A) a planar central section having peripheral edges;

B) a spring element fixed at one end thereof to said central section and having another end spaced from one peripheral edge;

C) a brace element connected to said spring element to be movably attached to said central section by said spring element, said brace element having an end spaced from said central section and moving between a first position at an angle to said central section and a second position to hold a patch in place, said spring element biasing said brace element toward said second position; and D) means on said central section for holding said central section in place for patching a wall.

5. An element used in patching holes in wallboard comprising:

A) a planar central section having peripheral edges;

B) a hinge fixed at one end thereof to said central section and having a second end and having a material memory;

C) a flap element fixed to the second end of the hinge to be movably attached to said central section by said hinge, said flap element moving between a first position at an angle to said central section and a second position co-planar with said central section, said hinge material memory biasing said flap element toward said second position when said flap element is in said first position; and D) handle means on said central section for moving said central section toward a wall to be patched.

6. An element used in patching holes in wallboard comprising:

A) a planar central section having peripheral edges;

B) a brace element fixed at one end thereof to said central section and extending past one peripheral edge of said central section and having another end spaced from said one peripheral edge;

C) a spring having one end thereof fixed to said central section and a second end;

D) a flap element fixed to the second end of said spring to be movably attached to said central section by said spring, said flap element moving between a first position at an angle to said central section and a second position co-planar with said central section, said spring biasing said flap element toward said second position and said flap element abutting said brace element when said flap element is in said second position; and E) handle means on said central section for moving said central section toward a wall to be patched.

7. The element defined in claim 6 further including adhesive on said flap element for fixing said flap element to the wall.

8. The element defined in claim 7 wherein said flap element is spaced from said central section.

9. The element defined in claim 7 further including a plurality of brace elements each fixed to said central section, a plurality of springs each fixed to said central section and a plurality of flap elements each fixed to a corresponding spring.

10. The element defined in claim 9 wherein said central section is planar.

11. The element defined in claim 9 wherein said central section is rectangular.

12. The element defined in claim 9 wherein said central section is square.

13. The element defined in claim 6 wherein said handle means includes a fastener and a fastener-receiving element on said central section.

14. The element defined in claim 6 wherein said flap element is trapezoidal in shape.

15. A method of patching a wall comprising steps of:

A) providing a patching element which includes a planar central section having peripheral edges, a brace element fixed at one end thereof to said central section and extending past one peripheral edge of said central section and having another end spaced from said one peripheral edge, a spring having one end thereof fixed to said central section and a second end, a flap element fixed to the second end of said spring to be movably attached to said central section by said spring, said flap element moving between a first position at an angle to said central section and a second position co-planar with said central section, said spring biasing said flap element toward said second position and said flap element abutting said brace element when said flap element is in said second position, handle means on said central section for moving said central section toward a wall to be patched, and adhesive on said flap element for fixing said flap element to the wall;

B) cutting a rectangular hole in a wall around the hole to be patched;

C) folding the flap element into the first position;

D) moving the patching element through the rectangular hole into the wall;

E) allowing the spring to move the flap element into the second position;

F) using the handle means, pulling the patching element towards the wall and contacting the adhesive with the wall to fix the patching element to the wall; and G) removing the handle means from the central section.

* * * * *